US008883304B2

(12) United States Patent
Liu et al.

(10) Patent No.: US 8,883,304 B2
(45) Date of Patent: Nov. 11, 2014

(54) SYNTHETIC FIBER

(75) Inventors: Chao-Huei Liu, Taipei Hsien (TW); Ruey-Loung Chern, Taipei Hsien (TW)

(73) Assignee: Taiwan Textile Research Institute, New Taipei (TW)

( * ) Notice: Subject to any disclaimer, the term of this patent is extended or adjusted under 35 U.S.C. 154(b) by 241 days.

(21) Appl. No.: 12/612,110

(22) Filed: Nov. 4, 2009

(65) Prior Publication Data

US 2010/0159241 A1 Jun. 24, 2010

(30) Foreign Application Priority Data

Dec. 18, 2008 (TW) ..... 97149538 A

(51) Int. Cl.

| | |
|---|---|
| ***D02G 3/00*** | (2006.01) |
| ***D04H 1/00*** | (2006.01) |
| ***D01F 8/00*** | (2006.01) |
| ***D01F 8/04*** | (2006.01) |
| ***D01D 5/34*** | (2006.01) |
| ***D01D 5/253*** | (2006.01) |

(52) U.S. Cl.

CPC .. *D01F 8/04* (2013.01); *D01D 5/34* (2013.01); *D01D 5/253* (2013.01)

USPC ..... 428/373; 442/327; 442/340

(58) Field of Classification Search

CPC ..... D04H 1/00; D02G 3/00; D01F 8/00

USPC ..... 428/364, 365, 913, 921; 442/414

See application file for complete search history.

(56) References Cited

U.S. PATENT DOCUMENTS

2006/0267245 A1 11/2006 Halbeisen et al.

FOREIGN PATENT DOCUMENTS

| | | | |
|---|---|---|---|
| JP | 05287615 A | * | 11/1993 |
| JP | 2002220743 A | * | 8/2002 |
| JP | 2004-052161 | | 2/2004 |
| JP | 2008-07902 | | 1/2008 |

OTHER PUBLICATIONS

Translation of JP 2002 220743 A.*

* cited by examiner

*Primary Examiner* — Jeremy R Pierce
*Assistant Examiner* — Ricardo E Lopez
(74) *Attorney, Agent, or Firm* — J.C. Patents

(57) ABSTRACT

A synthetic fiber including core and sheath is provided. The sheath covers the core and includes a plurality of segment portions and a plurality of sacrificial portions. The plurality of sacrificial portions are connected to the plurality of segment portions, where the plurality of segment portions and the plurality of sacrificial portions are arranged alternately to each other on an outer surface of the core, and the material of the plurality of segment portions is different with that of the plurality of sacrificial portions.

12 Claims, 2 Drawing Sheets

SYNTHETIC FIBER

CROSS-REFERENCE TO RELATED APPLICATION

This application claims the priority benefit of Taiwan application serial no. 97149538, filed on Dec. 18, 2008. The entirety of the above-mentioned patent application is hereby incorporated by reference herein and made a part of specification.

BACKGROUND OF THE INVENTION

1. Field of the Invention

The present invention relates to a synthetic fiber. More particularly, the present invention relates to a synthetic fiber with high strength and multiple components.

2. Description of Related Art

With the continuous progress in science and technology, people have gradually increased their demands for textiles. Thus, researches that increase textile have been proposed in succession. Fabricating the synthetic fiber mechanically is one of the methods of increasing textile strength. According to the patent publication document US 2006/0267245A1 provided by EMPA in Switzerland, a designed mold is used to produce regular grooves on fiber surfaces by mechanical embossment. Through this method, a sub-micron structure can be produced and a surface micro-structural fiber is further fabricated.

On the other hand, conjugate spinning is another method of increasing textile strength. According to the patent document JP 3764132 provided by Kuraray in Japan, the conjugate spinning method is used to manufacture hetero-segmented cross-section fibers. Since two polymer filament materials of the hetero-segmented cross-section fibers have different viscosities and different cooling formation rates, one of the polymer filament materials can be removed so as to generate grooves, and flat multi-groove fibers are formed accordingly. However, the fibers manufactured with this method can only be fabricated into a flat-shape, which the groove structure can not be precisely controlled. As a consequence, the structure and the size of the fiber can not be controlled precisely. Moreover, the types of polymers used are also limited.

As disclosed in patent document JPA 2008-7902 by Teijin in Japan, the segment component is used to manufacture synthetic fibers with a plurality of grooves. This patent fabricates particular grooves through a polymer material with a high dissolving rate difference and manufactures fibers having 50-500 segments using the conjugate spinning method. This fiber is a type of bi-component fiber. Nevertheless, this method can only control a groove width, and a groove formation is unstable and tends to break completely so as to result in groove formation failures. Moreover, the segments to be dissolved has an undesirable physical property.

SUMMARY OF THE INVENTION

The present invention provides a synthetic fiber, where a composition and micro-structures can be freely modified and high strength is obtained.

The present invention provides a synthetic fiber including a core and a sheath. Herein, the sheath covers the core and includes a plurality of segment portions and a plurality of sacrificial portions. The sacrificial portions are connected to the segment portions, where the segment portions and the sacrificial portions are arranged alternately on an outer surface of the core. Moreover, a material of the segment portions is different from a material of the sacrificial portions.

In one embodiment of the present invention, a cross-section of the core is a circular cross-section and a cross-section of the sheath is an annular cross-section. In addition, an inner diameter of the annular cross-section is the same as a diameter of the circular cross-section.

In one embodiment of the present invention, a volume ratio of the core and the sheath ranges from 1/9 to 9/1.

In one embodiment of the present invention, a weight ratio of the core and the sheath ranges from 1/9 to 9/1.

In one embodiment of the present invention, extending directions of the core, the segment portions, and the sacrificial portions are substantially the same.

In one embodiment of the present invention, the segment portions and the sacrificial portions are sheet structures.

In one embodiment of the present invention, volumes of each segment portion and each sacrificial portion are substantially the same.

In one embodiment of the present invention, the volumes of each segment portion and each sacrificial portion are different.

In one embodiment of the present invention, the volume ratios of each segment portion and each sacrificial portion range from 1/9 to 9/1.

In one embodiment of the present invention, weights of each segment portion and each sacrificial portion are substantially the same.

In one embodiment of the present invention, the weights of each segment portion and each sacrificial portion are different.

In one embodiment of the present invention, weight ratios of each segment portion and each sacrificial portion range from 1/9 to 9/1.

In one embodiment of the present invention, the material of the core and that of the segment portions are substantially the same.

In one embodiment of the present invention, the material of the core and that of the segment portions are different, and the material of the core and that of the sacrificial portions are also different. The material of segment portions and sacrificial portions are different.

In light of the foregoing, as the synthetic fiber provided in the present invention has a structure including the core and the sheath, the present invention may freely modify the components and the micro-structures of the core and the sheath so as to obtain great strength.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
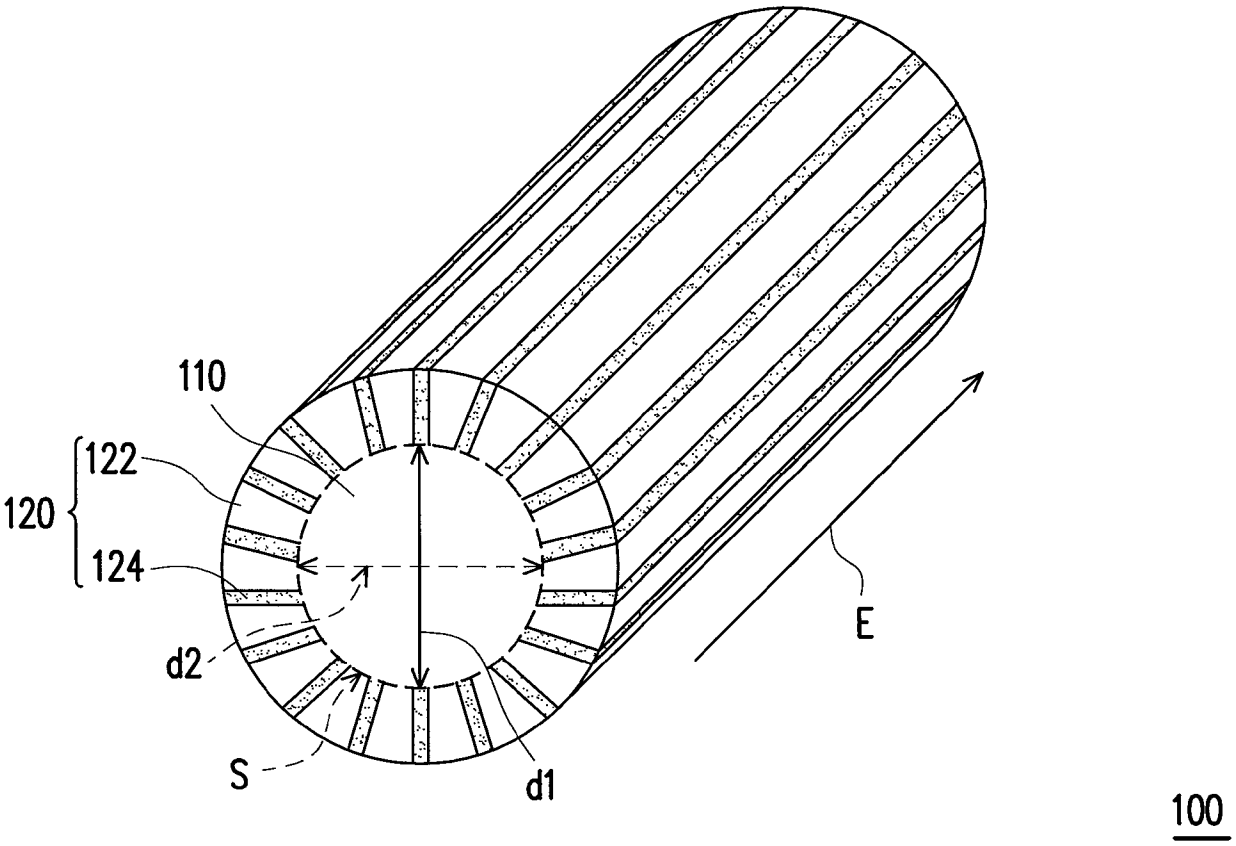
FIG. 1 is a perspective view of a synthetic fiber according to one embodiment of the present invention.

FIG. 1 is a perspective view of a synthetic fiber according to one embodiment of the present invention. Referring to FIG.

1, a synthetic fiber 100 in the present invention includes a core 110 and a sheath 120. Here, the sheath 120 covers the core 110 and includes a plurality of segment portions 122 and a plurality of sacrificial portions 124 (shown in bold lines). The sacrificial portions 124 are connected to the segment portions 122, wherein the segment portions 122 and the sacrificial portions 124 are arranged alternately on an outer surface S of the core 110. Moreover, a material of the segment portions 122 is different from a material of the sacrificial portions 124.

In one embodiment of the present invention, the material of the core 110 is, for example, a thermoplastic polymer. As an example, the material of the core 110 may be polyesters, polyamides, or polyalkenes. Specifically, the polyesters include polyethylene terephthalate, polypropylene terephthalate, and polybutylene terephthalate, etc. The polyamides include polyimide and polyhexamethylene adipamide, etc. Moreover, the polyalkenes may be polyethylene and polypropylene, etc.

The material of the segment portions 122 is a thermoplastic polymer, for example. For instance, the material of the segment portions 122 may be polyesters, polyamides, or polyalkenes. The polyesters include polyethylene terephthalate, polypropylene terephthalate, and polybutylene terephthalate, etc. The polyamides includes polyimide and polyhexamethylene adipamide, etc. Moreover, the polyalkenes may be polyethylene and polypropylene, etc. Furthermore, the material of the sacrificial portions 124 is a sacrificial thermoplastic polymer such as thermoplastic polyvinyl alcohol or water soluble polyesters that can be removed in the subsequent manufacturing process.

Referring to FIG. 1, in the synthetic fiber 100 of the present embodiment, a cross-section of the core 110 is a circular cross-section, a cross-section of the sheath 120 is an annular cross-section, and an inner diameter d1 of the annular cross-section is the same as a diameter d2 of the circular cross-section. The synthetic fiber 100 of the present embodiment has an overall diameter of 7~40 micrometers. Moreover, shapes of the segment portions 122 and the sacrificial portions 124 are sheet structures, and extending directions E of the core 110, the segment portions 122, and the sacrificial portions 124 are substantially the same, for example. The width of the segment portions 122 is about 0.1~1.5 micrometers.

Accordingly, in an embodiment of the present invention, volumes the core 110 and the sheath 120 are the same. However, the present invention is not limited herein. In another embodiment of the present invention, the volumes of the core 110 and the sheath 120 may be different. Specifically, a volume ratio of the core 110 and the sheath 120 ranges from 1/9 to 9/1. The volume ratio of the core 110 and the sheath 120 within this range still falls in the scope of the present invention. In other embodiments of the present invention, the core 110 and the sheath 120 may have same weights or different weights. In one embodiment, as long as a weight ratio of the core 110 and the sheath 120 ranges from 1/9 to 9/1, it still falls in the scope of the present invention.

Furthermore, in an embodiment of the present invention, volumes of each segment portion 112 and each sacrificial portion 114 of the synthetic fiber 100 are substantially the same. In another embodiment of the present invention, volumes of each segment portion 112 and each sacrificial portion 114 may be different. In detail, as long as a volume ratio of each segment portion 112 and each sacrificial portion 114 ranges from 1/9 to 9/1, those skilled in the art may alter the volume ratio of the segment portions 112 and the sacrificial portions 114 according to actual design needs.

In another embodiment of the present invention, weights of each segment portion 112 and each sacrificial portion 114 may be substantially the same or different. Moreover, the volume ratio also ranges from 1/9 to 9/1. Those skilled in the art may modify the weight ratio of the segment portions 112 and the sacrificial portions 114 according to actual design needs.

In fact, when manufacturing the synthetic fiber 100, the design of the manufacturing apparatus may be utilized, for example, through the disposition of spinnerets (not shown) or distribution plates (not shown) and the heat provided by a heating apparatus such that the material of the segment portions 122 and the sacrificial portions 124 covers the outer surface S of the core 110. After forming the structure of the synthetic fiber 100, the sheath 120 is dyed or performed with other processing procedures optionally.

It should be noted that in the aforementioned embodiment, the material of the core 110 and the segment portions 112 in the synthetic fiber 100 may be the same, as the white portion of the synthetic fiber 100 illustrated in FIG. 1. For example, the material of the core 110 and the segment portions 112 in the synthetic fiber 100 is semi dull polyethylene terephthalate or SDPET, while the material of the sacrificial portions 124 is ESPET. The weight percentage of the core 110 is about 40%, the weight percentage of the segment portions 112 is about 43%, and the weight percentage of the sacrificial portions 124 is about 17%. In another example, the material of the core 110 and the segment portions 112 in the synthetic fiber 100 is semi dull polycaprolactam or SDPA6, while the material of the sacrificial portions 124 is ESPET. The weight percentage of the core 110 is about 30%, the weight percentage of the segment portions 112 is about 50%, and the weight percentage of the sacrificial portions 124 is about 20%. Herein, the synthetic fiber 100 is composed by two materials. For example, the material of the core 110 in the synthetic fiber 100 is high shrinkage polyethylene terephthalate or HSPET, the material of the segment portions 112 is SDPET, while the material of the sacrificial portions 124 is SDPA6. The weight percentage of the core 110 is about 30%, the weight percentage of the segment portions 112 is about 45%, and the weight percentage of the sacrificial portions 124 is about 25%. However, the present invention does not limit the synthetic fiber 100 to be composed by only two component materials.

Figure 2:
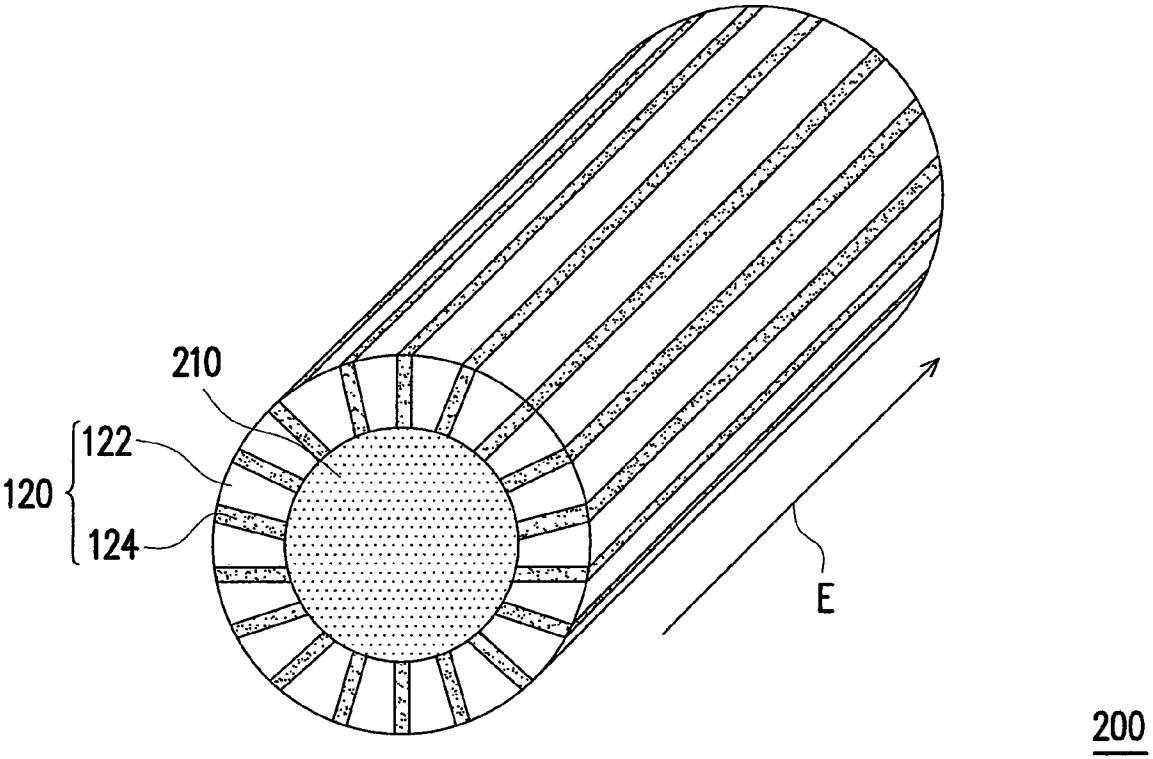
FIG. 2 is a perspective view of a synthetic fiber according to another embodiment of the present invention.

FIG. 2 is a perspective view of a synthetic fiber in another embodiment of the present invention. Referring to FIG. 2, in a synthetic fiber 200 of the present embodiment, a core 210, a plurality of segment portions 122, and a plurality of sacrificial portions 124 may be manufactured with three different materials. In other words, a material of the core 210 and a material of the segment portions 122 are different, and a material of the core 210 and that of the sacrificial portions 124 are also different.

In summary, as the synthetic fiber provided by the present invention has a structure that includes the core and the sheath, the synthetic fiber of the present invention has better fiber strength. Moreover, the present invention obtains synthetic fibers of different strengths by adjusting the composition of the segment portions and the sacrificial portions, and the ratio of the core and the sheath.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A synthetic fiber, comprising:

a solid core;

a sheath covering the solid core, wherein the sheath comprises: a plurality of segment portions; and a plurality of sacrificial portions connected to the plurality of segment portions, wherein the plurality of segment portions and the plurality of sacrificial portions are arranged alternately on an outer surface of the solid core:

wherein the materials of the solid core, the segment portions and the sacrificial portions are different from each other, wherein a cross-section of the solid core is a circular cross-section while a cross-section of the sheath is an annular cross-section, and an inner diameter of the annular cross-section is the same as a diameter of the circular cross-section, in the cross-section of the synthetic fiber, both the segment portions and the sacrificial portions are directly in contact with an outer circumference of the solid core, and the segment portions and the sacrificial portions are radially extended from the outer circumference of the solid core toward an outside of the synthetic fiber, and wherein a material of the solid core is high shrinkage polyethylene terephthalate or HSPET, a material of the segment portions is semi dull polyethylene terephthalate or SDPET, and a material of the sacrificial portions is semi dull polycaprolactam or SDPA6, and wherein weight percentage of the solid core, segment portions, and sacrificial portions are 30%, 45%, and 25%, respectively.

2. The synthetic fiber as claimed in claim 1, wherein a volume ratio of the solid core and the sheath ranges from 1/9 to 9/1.

3. The synthetic fiber as claimed in claim 1, wherein a weight ratio of the solid core and the sheath ranges from 1/9 to 9/1.

4. The synthetic fiber as claimed in claim 1, wherein extending directions of the solid core, the plurality of segment portions, and the plurality of sacrificial portions are substantially the same.

5. The synthetic fiber as claimed in claim 1, wherein the plurality of segment portions and the plurality of sacrificial portions are sheet structures.

6. The synthetic fiber as claimed in claim 1, wherein a volume of each of the plurality of segment portions and a volume of each of the plurality of sacrificial portions are substantially the same.

7. The synthetic fiber as claimed in claim 1, wherein the volume of each of the plurality of segment portions and the volume of each of the plurality of sacrificial portions are different.

8. The synthetic fiber as claimed in claim 1, wherein a volume ratio of each of the plurality of segment portions and each of the plurality of sacrificial portions ranges from 1/9 to 9/1.

9. The synthetic fiber as claimed in claim 1, wherein a weight of each of the plurality of segment portions and a weight of each of the plurality of sacrificial portions are substantially the same.

10. The synthetic fiber as claimed in claim 1, wherein the weight of each of the plurality of segment portions and the weight of each of the plurality of sacrificial portions are different.

11. The synthetic fiber as claimed in claim 1, wherein a weight ratio of each of the plurality of segment portions and each of the plurality of sacrificial portions ranges from 1/9 to 9/1.

12. A synthetic fiber, comprising:

a solid core;

a sheath covering the solid core, wherein the sheath comprises: a plurality of segment portions; and a plurality of sacrificial portions connected to the plurality of segment portions, wherein the plurality of segment portions and the plurality of sacrificial portions are arranged alternately on an outer surface of the solid core:

wherein the materials of the solid core, the segment portions and the sacrificial portions are different from each other, wherein the solid core, the segment portions and the sacrificial portions are independent components, wherein a cross-section of the solid core is a circular cross-section while a cross-section of the sheath is an annular cross-section, and an inner diameter of the annular cross-section is the same as a diameter of the circular cross-section, in the cross-section of the synthetic fiber, both the segment portions and the sacrificial portions are directly in contact with an outer circumference of the solid core, and the segment portions and the sacrificial portions are radially extended from the outer circumference of the solid core toward an outside of the synthetic fiber, and wherein a material of the solid core is high shrinkage polyethylene terephthalate or HSPET, a material of the segment portions is semi dull polyethylene terephthalate or SDPET, and a material of the sacrificial portions is semi dull polycaprolactam or SDPA6, and wherein weight percentage of the solid core, segment portions, and sacrificial portions are 30%, 45%, and 25%, respectively.

* * * * *